US010005303B2

(12) United States Patent
Giacobbi et al.

(10) Patent No.: US 10,005,303 B2
(45) Date of Patent: Jun. 26, 2018

(54) SYSTEM FOR DETECTING INOPERATIVE INKJETS IN THREE-DIMENSIONAL OBJECT PRINTING USING A PROFILOMETER AND PREDETERMINED TEST PATTERN PRINTING

(71) Applicant: Xerox Corporation, Norwalk, CT (US)

(72) Inventors: James L. Giacobbi, Penfield, NY (US); Matthew R. McLaughlin, Rochester, NY (US); Victoria L. Warner, Caledonia, NY (US)

(73) Assignee: Xerox Corporation, Norwalk, CT (US)

( * ) Notice: Subject to any disclaimer, the term of this patent is extended or adjusted under 35 U.S.C. 154(b) by 496 days.

(21) Appl. No.: 14/231,340

(22) Filed: Mar. 31, 2014

(65) Prior Publication Data

US 2015/0273915 A1 Oct. 1, 2015

(51) Int. Cl.

| | |
|---|---|
| ***B41J 2/165*** | (2006.01) |
| ***B41J 29/393*** | (2006.01) |
| ***B41J 2/175*** | (2006.01) |
| ***B41J 2/21*** | (2006.01) |
| ***B41J 29/02*** | (2006.01) |

(52) U.S. Cl.

CPC ..... *B41J 29/393* (2013.01); *B41J 2/16579* (2013.01); *B41J 2/175* (2013.01); *B41J 2/2142* (2013.01); *B41J 29/02* (2013.01)

(58) Field of Classification Search

CPC ..... B41J 29/393; B29C 67/0059; B41C 1/003

USPC ..... 347/19

See application file for complete search history.

(56) References Cited

U.S. PATENT DOCUMENTS

| | | | | |
|---|---|---|---|---|
| 2002/0167101 | A1* | 11/2002 | Tochimoto et al. | 264/40.1 |
| 2002/0183964 | A1* | 12/2002 | Handa et al. | 702/167 |
| 2004/0012112 | A1 | 1/2004 | Davidson et al. | |
| 2004/0012114 | A1* | 1/2004 | Eyerer et al. | 264/117 |
| 2004/0131778 | A1* | 7/2004 | Verhoest | B41C 1/003 427/258 |
| 2006/0054039 | A1* | 3/2006 | Kritchman et al. | 101/424.1 |
| 2006/0111807 | A1* | 5/2006 | Gothait et al. | 700/119 |
| 2006/0141145 | A1 | 6/2006 | Davidson et al. | |
| 2009/0011066 | A1 | 1/2009 | Davidson et al. | |
| 2010/0121476 | A1* | 5/2010 | Kritchman | 700/119 |
| 2010/0151136 | A1 | 6/2010 | Davidson et al. | |
| 2011/0249048 | A1* | 10/2011 | Gullentops | B29C 67/0059 347/5 |

FOREIGN PATENT DOCUMENTS

WO 03/026876 A2 4/2003

* cited by examiner

*Primary Examiner* — Sharon A Polk

(74) *Attorney, Agent, or Firm* — Maginot Moore & Beck LLP

(57) ABSTRACT

A printer detects inoperative inkjets during printing of three-dimensional objects. The printer includes an area where a printhead ejects material in a predetermined pattern and a profilometer is operated to measure the ejected material in the area. The measurements are used to identify inoperative inkjets or inkjets that operate errantly.

16 Claims, 5 Drawing Sheets

SYSTEM FOR DETECTING INOPERATIVE INKJETS IN THREE-DIMENSIONAL OBJECT PRINTING USING A PROFILOMETER AND PREDETERMINED TEST PATTERN PRINTING

TECHNICAL FIELD

The device disclosed in this document relates to printers that produce three-dimensional objects and, more particularly, to accurate detection of inoperative inkjets in such printers.

BACKGROUND

Digital three-dimensional manufacturing, also known as digital additive manufacturing, is a process of making a three-dimensional solid object of virtually any shape from a digital model. Three-dimensional printing is an additive process in which one or more printheads eject successive layers of material on a substrate in different shapes. Three-dimensional printing is distinguishable from traditional object-forming techniques, which mostly rely on the removal of material from a work piece by a subtractive process, such as cutting or drilling.

The production of a three-dimensional object with these printers can require hours or, with some objects, even days. One issue that arises in the production of three-dimensional objects with a three-dimensional printer is consistent functionality of the inkjets in the printheads that eject the drops of material that form the objects. During printing of an object, one or more inkjets can deteriorate by ejecting the material at an angle, rather than normal, to the printhead, ejecting drops that are smaller than an inkjet should eject, or by failing to eject any drop at all. An inkjet suffering from any of these operational deficiencies is known as an inoperative inkjet. If the operational status of one or more inkjets deteriorates during object printing, the quality of the printed object cannot be assessed until the printing operation is completed. Consequently, print jobs requiring many hours or multiple days can produce objects that do not conform to specifications due to inoperative inkjets in the printheads. Once such objects are detected, the printed objects are scrapped, restorative procedures are applied to the printheads to restore inkjet functionality, and the print job is repeated. An apparatus that enables detection of inoperative inkjets while printing would enable restorative procedures to be applied during object printing so a properly formed object can be produced. In this manner, product yield for the printer is improved and its printing is more efficient. The apparatus should be able to detect inoperative inkjets that eject a multitude of printing materials, such as clear, colored, translucent, phosphorescent, and waxy materials.

SUMMARY

An apparatus that enables inoperative inkjet detection in three-dimensional printers includes a profilometer positioned adjacent a planar member located to receive drops of material ejected from inkjets in a printhead, the profilometer being configured to generate measurements of drops ejected onto the planar member, and a controller operatively connected to the profilometer, the controller being configured to detect the printhead and generate a signal for the printhead to be operated to form a line of drops on the planar member, to move and operate the profilometer to enable generation of measurement data of the drops of material on the planar member, and to identify inoperable inkjets in the printhead with reference to the measurement data generated by the profilometer.

A printer that incorporates the apparatus for detecting inoperative inkjets includes a printhead configured with inkjets to eject drops of material, a planar member positioned opposite the printhead to receive drops ejected from the printhead, a profilometer configured to generate measurements of drops ejected onto the planar member, and a controller operatively connected to the profilometer and the printhead, the controller being configured to move the printhead and operate the printhead to form a line of drops on the planar member, to move and operate the profilometer to enable generation of measurement data of the drops on the planar member, and to identify inoperable inkjets in the printhead with reference to the measurement data generated by the profilometer.

BRIEF DESCRIPTION OF THE DRAWINGS

The foregoing aspects and other features of an apparatus or printer that detects inoperative inkjets during three-dimensional printing are explained in the following description, taken in connection with the accompanying drawings.

DETAILED DESCRIPTION

Figure 1:
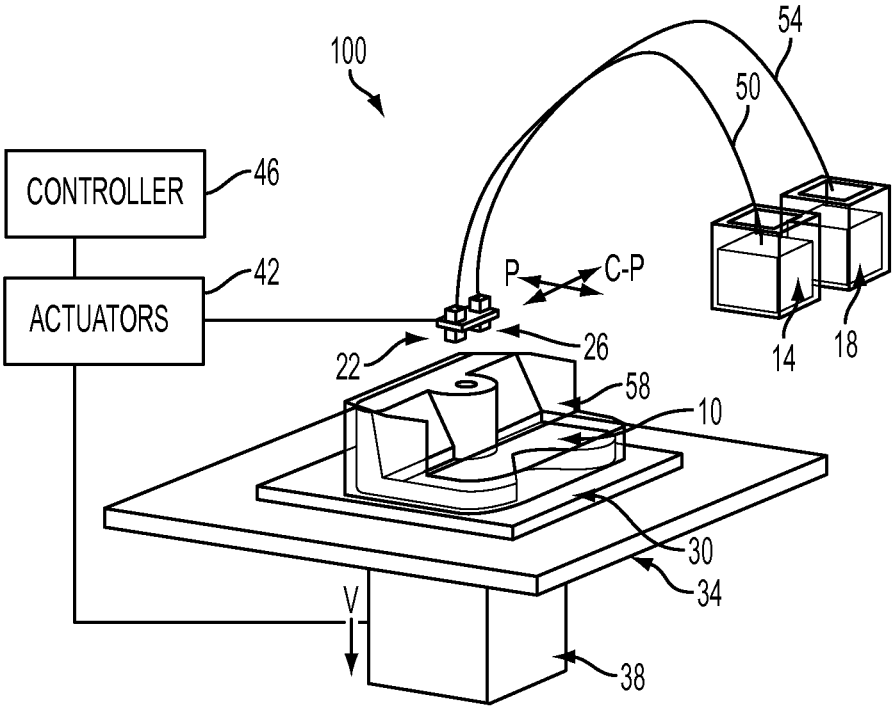
FIG. 1 is a perspective view of a three-dimensional object printer.

For a general understanding of the environment for the device disclosed herein as well as the details for the device, reference is made to the drawings. In the drawings, like reference numerals designate like elements.

FIG. 1 shows a configuration of components in a printer 100, which produces a three-dimensional object or part 10. As used in this document, the term "three-dimensional printer" refers to any device that ejects material with reference to image data of an object to form a three-dimensional object. The printer 100 includes a support material reservoir 14, a build material reservoir 18, a pair of inkjet printheads 22, 26, a build substrate 30, a planar support member 34, a columnar support member 38, an actuator 42, and a controller 46. Conduit 50 connects printhead 22 to support material reservoir 14 and conduit 54 connects printhead 26 to build material reservoir 18. Both inkjet printheads are operated by the controller 46 with reference to three-dimensional image data in a memory operatively connected to the controller to eject the support and build materials supplied to each respective printhead. The build material forms the structure of the part 10 being produced, while the support structure 58 formed by the support material enables the build material to maintain its shape while the material solidifies as the part is being constructed. After the part is finished, the support structure 58 is removed by washing, blowing, or melting.

The controller 46 is also operatively connected to at least one and possibly more actuators 42 to control movement of the planar support member 34, the columnar support member 38, and the printheads 22, 26 relative to one another. That is, one or more actuators can be operatively connected to structure supporting the printheads to move the printheads in a process direction and a cross-process direction with reference to the surface of the planar support member. Alternatively, one or more actuators can be operatively connected to the planar support member 34 to move the surface on which the part is being produced in the process and cross-process directions in the plane of the planar support member 34. As used herein, the term "process direction" refers to movement along one axis in the surface of the planar support member 34 and "cross-process direction" refers to movement along an axis in the planar support member surface that is orthogonal to the process direction axis in that surface. These directions are denoted with the letters "P" and "C-P" in FIG. 1. The printheads 22, 26 and the columnar support member 38 also move in a direction that is orthogonal to the planar support member 34. This direction is called the vertical direction in this document, is parallel to the columnar support member 38, and is denoted with the letter "V" in FIG. 1. Movement in the vertical direction is achieved with one or more actuators operatively connected to the columnar member 38, by one or more actuators operatively connected to the printheads 22, 26, or by one or more actuators operatively connected to both the columnar support member 38 and the printheads 22, 26. These actuators in these various configurations are operatively connected to the controller 46, which operates the actuators to move the columnar member 38, the printheads 22, 26, or both in the vertical direction.

Figure 2:
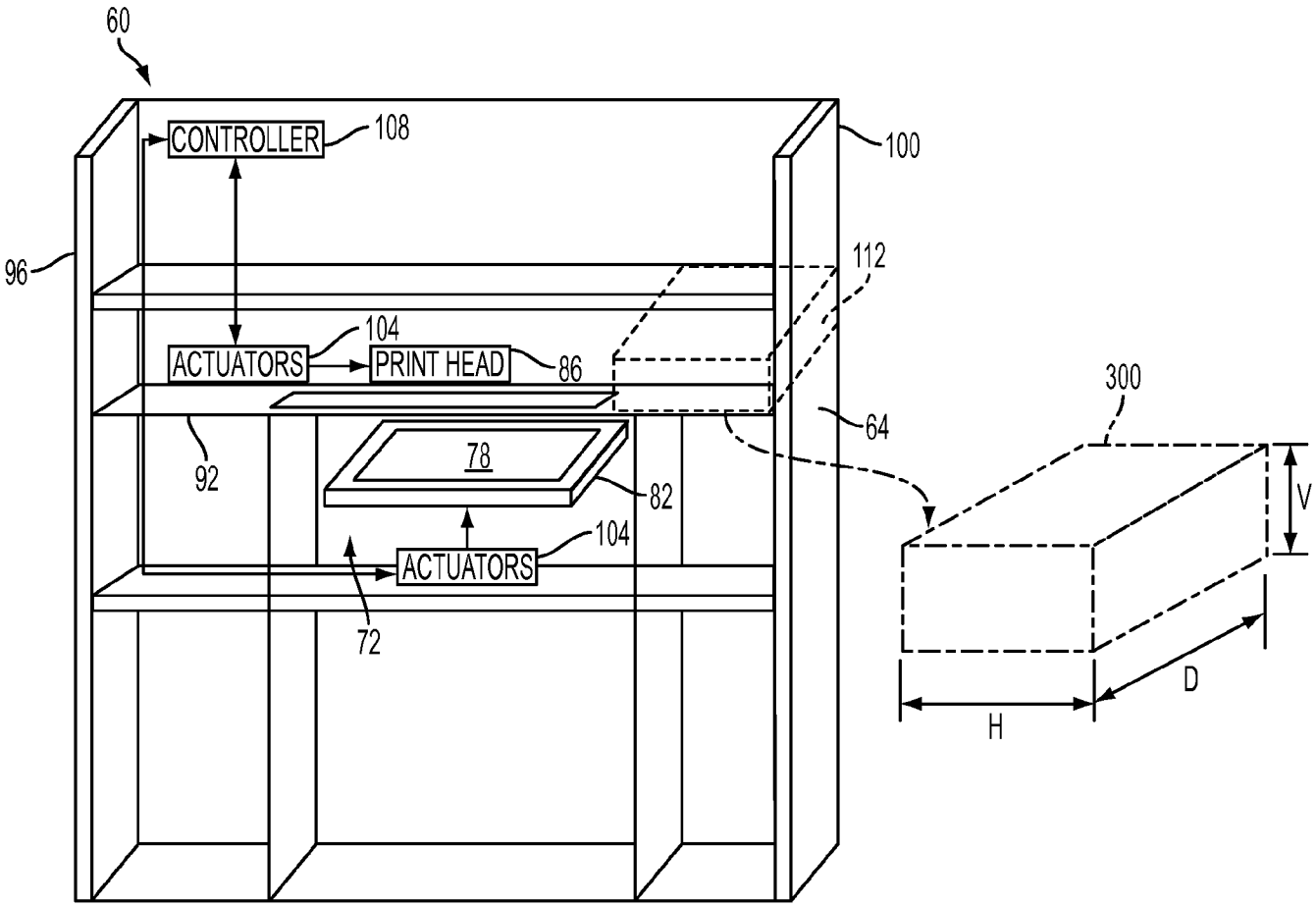
FIG. 2 is front view of a three-dimensional object printer having a housing that depicts a space within the housing for a module that enables inoperative inkjets in the printhead to be detected during a printing operation.

A three-dimensional object printer having a housing is shown in FIG. 2. That printer 60 has a housing 64. Within the housing 64 are six compartments that are generally cubic in shape. The housing 64 is shown in FIG. 2 without the doors that close to conceal the compartments. Compartment 72 includes a planar support 78 on a movable platform 82. Movable platform 82 is configured with one or more actuators and guide members (not shown) to enable the movable platform 82 to move up and down in a vertical direction. The planar support 78 is the surface on which a three-dimensional object is formed. In some embodiments, the printhead 86 has a length that is approximately equal to the length of the planar support 78 in the direction from the back wall of compartment 72 to the opening at the front of the compartment. In these embodiments, printhead 86 is mounted on support member 92 in the space between sidewalls 96 and 100 of housing 64 for linear reciprocating movement only. In other embodiments, the printhead 86 has a length that is less than the length of the planar support 78 in the direction from the back wall of compartment 72 to the opening at the front of the compartment. In these embodiments, printhead 86 is mounted on support member 92 in the space between sidewalls 96 and 100 of housing 64 for reciprocating movement in two orthogonal directions in a plane above compartment 72. In these various embodiments, one or more actuators 104 are operatively connected to the printhead 86. Controller 108 operates the actuators 104 to move the printhead 86 either linearly back and forth on support member 92 or to move the printhead in two orthogonal directions within a plane. By selectively operating the inkjets in the printhead 86 and vertically moving the support platform 82 and horizontally moving the printhead 86 on the member 92, a three-dimensional object can be formed on the planar support 78.

The area 112 outlined in dashes in FIG. 2 identifies the placement of a module that uses a profilometer to detect inoperative inkjets in the printer 60. As noted above, if an inkjet fails during printing of an object by either completely or partially failing to eject material or by errantly ejecting material in a skewed direction, the object being produced is malformed. Currently, this malformation cannot be detected until production of the object is finished. By using area 112 for optically sensing inoperative inkjets, printer 60 can be configured to detect inoperative inkjets during object production as described more fully below. Some components within the module 300 can move in the horizontal direction H, depth direction D, and vertical direction V as shown in the figure.

Figure 3:
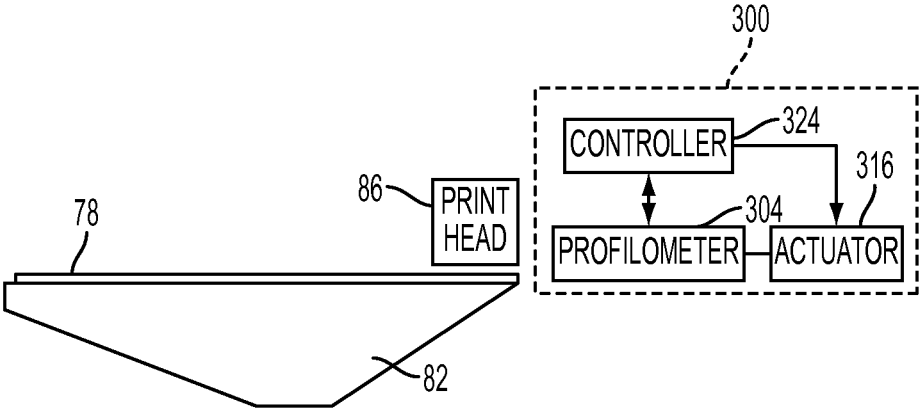
FIG. 3 is a side view of a module for detecting inoperative inkjets that fits in the space shown in FIG. 2.
Figure 4:
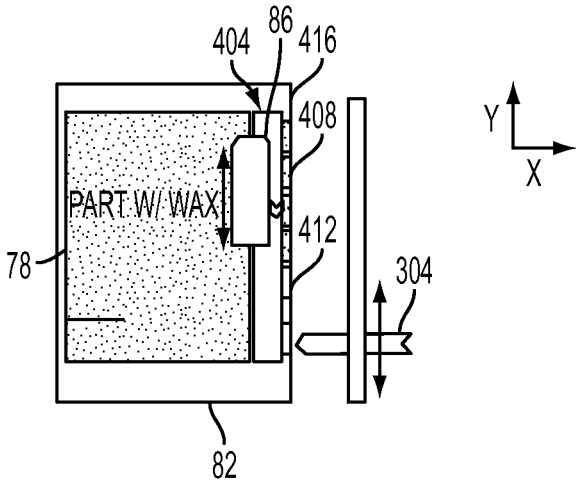
FIG. 4 is a top view of the module of FIG. 3 and the build area in the printer of FIG. 2

One embodiment of a module that detects inoperative inkjets ejecting materials during object printing is shown in the block diagram of FIG. 3. The module 300 is configured to fit within area 112 of printer 60. The module 300 includes a profilometer 304 configured with one or more actuators 316 and a controller 324. The profilometer is positioned adjacent the planar member 78 on the movable platform 82 and is oriented in the figure to direct white light onto a test pattern formed on the planar member 78. This orientation is depicted in FIG. 3 and FIG. 4 and it enables the profilometer to generate measurements of the test pattern structure as discussed in more detail below. As shown in FIG. 4, the profilometer 304 is mounted to a support member 414 for movement as indicated by the double headed arrow. In an alternative embodiment, the profilometer 304 is fixedly attached to the printhead 86 at a position that enables the printhead to eject material to form the test pattern and then controller 108 and actuator 104 operate to move the printhead to position the profilometer over the printed test pattern for the generation of measurements.

Figure 5:
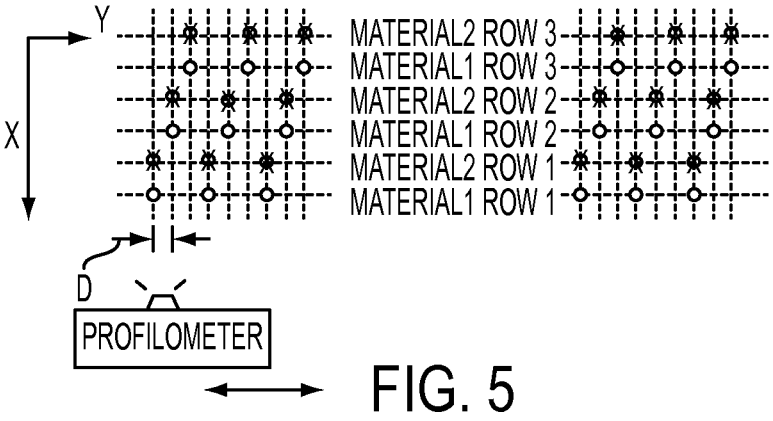
FIG. 5 is a schematic view of a portion of the inkjets in the printhead of the printer in FIG. 2 and the position of the profilometer in the module of FIG. 3
Figure 6:
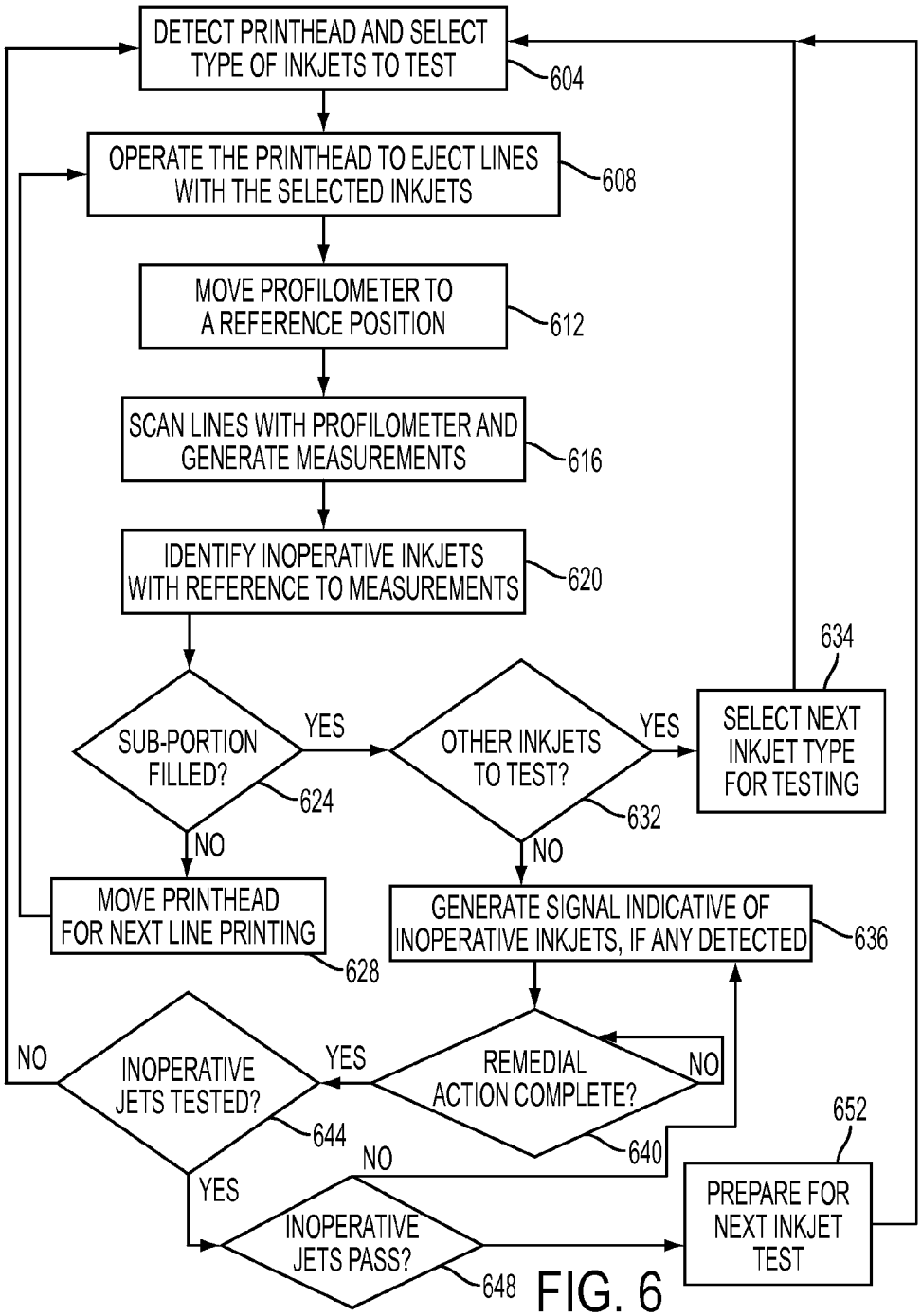
FIG. 6 is a flow diagram of a method for operating the module of FIG. 3.

Test pattern generation is discussed with reference to FIG. 5. In FIG. 5, the inkjets identified with an "X" are inkjets that eject support material and those inkjets identified with an "O" are inkjets that eject build material. The profilometer 304 directs a laser into the area printed with the test pattern to generate measurements of the reflections received from the test pattern. As shown in FIG. 4, the test pattern portion 404 of the planar member 78 is adjacent the opening in the module 300. A sub-portion 408 of the test pattern area is used for support material printing and the sub-portion 412 of the test pattern area is used for build material printing. To form the test pattern, the process shown in FIG. 6 is performed. In the description of this method, statements that a process is performing some task or function refers to a controller or general purpose processor executing programmed instructions stored in a memory operatively connected to the controller or processor to manipulate data or to operate one or more components in the printer to perform the task or function. The controller 324 noted above can be such a controller or processor. Alternatively, the controller 324 can be implemented with more than one processor and associated circuitry and components, each of which is configured to form one or more tasks or functions described herein.

In the process of FIG. 6, controller 108, from time to time, operates actuator 104 to move the printhead to test area 404 and, once there, in the Y direction to the sub-portion 408. Controller 324 detects the printhead in sub-portion 408 and selects the inkjets that eject support material for testing (block 604). Controller 324 generates a signal for controller 108 to operate the selected inkjets to eject a line of support material as controller 108 moves the printhead in the X direction (block 608). Once the printing is completed, the profilometer 304 is positioned at a home position 416 to establish a reference position (block 612). The controller 324 then moves the profilometer 304 in the Y direction across sub-portion 408 to generate measurements regarding a distance between the profilometer 304 and the end of each line that extends towards the profilometer 304 as well as the size/volume of the end of the line (block 616). Controller 324 analyzes the measurement data to identify inoperative inkjets (block 620). For example, if no end is detected where a line is expected then the inkjet is failing to eject any material at all. If the distance is greater than or less than some predetermined range about a predetermined expected distance for the end, then the inkjet is ejecting sporadically or errantly. As used in this document, an inkjet operating errantly is one that is ejecting material, but the path of the ejected material deviates from the expected flight path for an ejected drop or the mass of the ejected drop is not within a predetermined range about a predetermined drop mass. Likewise, if the end of the line has a size/volume that is greater than or less than some predetermined range about a predetermined expected size/volume for the end, then the inkjet is ejecting more material or less material, respectfully, than expected.

After the profilometer 304 generates the measurements for the line positions and the controller 324 has analyzed the measurements, controller 324 determines if the sub-portion where the selected inkjets are being tested is filled (block 624). If it is not, controller 324 generates a signal to the controller 108 to move the printhead in the Y direction (block 628). Controller 108 moves the printhead by an integral number of the distance between inkjets in the Y direction plus an integral number of a single pixel resolution in the distance between inkjets in the Y direction. For example, in one embodiment, the distance D (FIG. 5) between inkjets is 0.0266", which is 675 microns. To move the printhead after a set of lines has been printed and measured, the controller 108 moves the printhead five times 675 microns to reach a fifth inkjet position and then moves the printhead three times 67.5 microns, since ten pixels can be printed in the distance between inkjets in this embodiment. This movement helps ensure that the effect of the inoperative inkjets is moved about the sub-portion 408 during the testing of the inkjets. The inkjets that eject support material are operated again (block 608) to form lines extending towards the profilometer and then the profilometer is moved to the reference position 416 (block 612), scanned again in the Y direction to generate measurements of the line ends (block 616), which the controller 324 analyzes to detect inoperative inkjets (block 620). This process continues until an inkjet ejecting the selected material has been operated at each pixel position to form a line (block 624). Controller 324 determines if inkjets remain to be tested (block 632) and if other inkjets need testing, controller 324 generates a signal for controller 108 to test the inkjets ejecting the other material (block 634). In response, controller 108 moves the printhead 86 to the other sub-portion 412 where it is detected by the controller 324 and the process continues until the inkjets ejecting the other type of material are tested (blocks 604 to 628). If no additional inkjets need to be tested, then identification of the inoperative inkjets is provided to an operator (block 636), who can take appropriate action.

The operator can take remedial action, such as running a maintenance procedure to restore operational status to inoperative inkjets. Controller 324 detects the completion of the maintenance procedure (block 640) and repeats the process in FIG. 6 only for the inoperative inkjets (block 604). This process enables the restored inkjets to eject material into the gaps where they previously failed to eject material. If the inkjets are not confirmed as being operational, the operator is again notified for further action (block 648). Otherwise, the test pattern area 404 has been filled so the support platform is lowered a predetermined distance to enable the next layer of the object to be formed and the inkjets tested (block 652).

The apparatus and methods described above are useful for detecting clear materials as well as colored or opaque materials since the profilometer measures structure and does not require contrast for generating the measurements. In one embodiment, the profilometer is an HS1000 profilometer available from Nanovea of Irvine, Calif. This instrument is capable of scan speeds of 1 meter/second and a sample rate of 31 KHz.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printer comprising:

a printhead configured with inkjets to eject drops of material;

a planar member positioned opposite the printhead to receive drops ejected from the printhead;

a profilometer configured to generate measurements of drops ejected onto the planar member; and a controller operatively connected to the profilometer and the printhead, the controller being configured to move the printhead and operate the printhead to form a line of drops on the planar member, to move and operate the profilometer to enable generation of measurement data of the drops on the planar member, and to identify inoperative inkjets in the printhead with reference to the measurement data generated by the profilometer.

2. The printer of claim 1, the printhead being further configured to eject a first material from a first number of inkjets in the printhead and to eject a second material from a second number of inkjets in the printhead, no inkjet in the printhead being configured to eject the first material and the second material.

3. The printer of claim 2, the controller being further configured to move the printhead in a first direction to position inkjets that eject the first material for line formation and to move the printhead in a second direction while the inkjets that eject the first material are being operated, the first and second directions being orthogonal in a plane that is parallel with the planar member.

4. The printer of claim 3, the controller being further configured to move the printhead in the first direction with reference to a distance between inkjets and a number of pixels that can be printed in the distance between inkjets.

5. The printer of claim 2, the controller being further configured to move the printhead to a first portion of the planar member to operate the inkjets that eject the first material and to move the printhead to a second portion of the planar member to operate the inkjets that eject the second material.

6. The printer of claim 1, the profilometer being further configured to generate measurements of a distance between the profilometer and an end of each line of drops formed on the planar member to enable identification of inoperative inkjets.

7. The printer of claim 6, the profilometer being further configured to generate measurements of a volume of an end of each line of drops formed on the planar member to enable identification of inkjets that operate errantly.

8. The printer of claim 1, the profilometer being further configured to generate measurements of a volume of an end of each line of drops formed on the planar member to enable identification of inkjets that operate errantly.

9. An apparatus comprising:

a profilometer positioned adjacent a planar member located to receive drops of material ejected from inkjets in a printhead, the profilometer being configured to generate measurements of drops ejected onto the planar member; and a controller operatively connected to the profilometer, the controller being configured to detect the printhead and generate a signal for the printhead to be operated to form a line of drops on the planar member, to move and operate the profilometer to enable generation of measurement data of the drops of material on the planar member, and to identify inoperable inkjets in the printhead with reference to the measurement data generated by the profilometer.

10. The apparatus of claim 9, the controller being further configured to generate a signal to operate the printhead to eject a first material from a first number of inkjets in the printhead and to operate the printhead to eject a second material from a second number of inkjets in the printhead without operating any inkjet in the printhead to eject both the first material and the second material.

11. The apparatus of claim 10, the controller being further configured to generate a first signal to move the printhead in a first direction to position inkjets that eject the first material for line formation and to generate a second signal to move the printhead in a second direction while the inkjets that eject the first material are being operated, the first and second directions being orthogonal in a plane that is parallel with the planar member.

12. The apparatus of claim 11, the controller being further configured to move the printhead in the first direction with reference to a distance between inkjets and a number of pixels that can be printed in the distance between inkjets.

13. The apparatus of claim 10, the controller being further configured to move the printhead to a first portion of the planar member to operate the inkjets that eject the first material and to move the printhead to a second portion of the planar member to operate the inkjets that eject the second material.

14. The apparatus of claim 9, the profilometer being further configured to generate measurements of a distance between the profilometer and an end of each line of drops formed on the planar member to enable identification of inoperative inkjets.

15. The apparatus of claim 14, the profilometer being further configured to generate measurements of a volume of an end of each line of drops formed on the planar member to enable identification of inkjets that operate errantly.

16. The apparatus of claim 9, the profilometer being further configured to generate measurements of a volume of an end of each line of drops formed on the planar member to enable identification of inkjets that operate errantly.

* * * * *